US005904628A

United States Patent [19]

MacKay, Jr. et al.

[11] Patent Number: 5,904,628

[45] Date of Patent: May 18, 1999

[54] GOLF CLUB

[75] Inventors: Jack W MacKay, Jr., Mt. Pleasant, Tex.; George E. Manning, Prospect, Ky.

[73] Assignee: Hillerich & Bradsby Co., Louisville, Ky.

[21] Appl. No.: 08/873,698

[22] Filed: Jun. 12, 1997

[51] Int. Cl.[6] ..... A63B 53/00

[52] U.S. Cl. ..... 473/326; 473/318; 473/332; 473/300

[58] Field of Search ..... 473/318, 324, 473/326, 332, 329, 345, 316, 317, 323, 300

[56] References Cited

U.S. PATENT DOCUMENTS

| | | | |
|---|---|---|---|
| 1,831,255 | 11/1931 | Menzies . | |
| 1,918,485 | 7/1933 | Nelson . | |
| 2,220,852 | 11/1940 | Scott | 473/316 |
| 2,639,804 | 5/1953 | Merahn | 206/4 |
| 3,037,775 | 6/1962 | Busch | 273/171 |
| 3,574,379 | 4/1971 | Jordan | 293/71 |
| 3,762,707 | 10/1973 | Santorelli | 273/80 B |
| 3,817,522 | 6/1974 | Simmons | 273/78 |
| 3,993,314 | 11/1976 | Harrington et al. | 473/326 |
| 4,205,845 | 6/1980 | Kanne | 473/316 |
| 4,591,160 | 5/1986 | Piragino | 273/167 R |
| 5,064,197 | 11/1991 | Eddy | 273/167 H |
| 5,135,227 | 8/1992 | Okumoto et al. | 273/167 R |
| 5,263,713 | 11/1993 | Taylor et al. | 273/78 |
| 5,316,300 | 5/1994 | Simmons | 273/80 R |
| 5,332,222 | 7/1994 | Perry | 273/162 F |
| 5,351,959 | 10/1994 | Duffy | 273/170 |
| 5,410,798 | 5/1995 | Lo | 29/527.2 |
| 5,425,535 | 6/1995 | Gee | 273/78 |
| 5,470,071 | 11/1995 | Hsu et al. | 273/186.4 |
| 5,522,594 | 6/1996 | Taylor et al. | 473/131 |
| 5,540,625 | 7/1996 | Koch et al. | 473/318 |
| 5,607,364 | 3/1997 | Hedrick et al. | 473/318 |
| 5,632,693 | 5/1997 | Painter | 473/318 |

FOREIGN PATENT DOCUMENTS

| | | | |
|---|---|---|---|
| 124401 | 5/1945 | Australia . | |
| 52-37126 | 3/1977 | Japan . | |
| 02052678 | 2/1990 | Japan . | |
| 07008580 | 1/1995 | Japan . | |
| 08024377 | 1/1996 | Japan . | |
| 09084905 | 3/1997 | Japan . | |
| 24274 | of 1898 | United Kingdom | 273/78 |
| 1048123 | 11/1966 | United Kingdom | 273/80 |
| 2 247 628 | 3/1992 | United Kingdom . | |
| 2247932 | 3/1992 | United Kingdom . | |

*Primary Examiner*—Kien T. Nguyen
*Attorney, Agent, or Firm*—Middleton & Reutlinger; James C. Eaves, Jr.

[57] ABSTRACT

Various forms of golf clubs are disclosed, which include one or more inflatable bladders in the golf club head and/or golf club shaft, as well as internal and external grooving of the golf club shaft. Such golf clubs have enhanced characteristics for driving a golf ball to move in a desired trajectory. The unique structural components of the golf club provide for reinforcing, rigidifying, reducing weight and more effective control of the golf club during the swing. A higher club head speed when impacting a golf ball, more stability on off center hits, reduced vibration upon ball impact, improved sound characteristics, and improved "feel" can be achieved.

14 Claims, 7 Drawing Sheets

GOLF CLUB

BACKGROUND OF THE INVENTION

1. Field of the Invention

The present invention relates to golf clubs and more particularly to golf clubs which have enhanced characteristics for driving a golf ball in a desired trajectory with improved sound and "feel" and which include structural components for reinforcing, rigidifying, reducing weight and providing more effective control of the golf club during the swing and impacting a golf ball.

2. Description of the Prior Art

Various efforts have been made to improve the construction of golf clubs including arrangements to reinforce or rigidify the club in both the club head area and the shaft area. The following U.S. patents are exemplary of such endeavors:

| | | |
|---|---|---|
| 1,831,255 | 4,591,160 | 5,351,959 |
| 1,918,485 | 5,064,197 | 5,410,798 |
| 2,639,804 | 5,135,227 | 5,425,535 |
| 3,037,775 | 5,263,713 | 5,470,071 |
| 3,574,379 | 5,316,300 | 5,522,594 |
| 3,762,707 | 5,332,222 | 5,540,625 |
| 3,817,522 | | |

The above listed patents disclose golf club heads and shafts which are filled with fluids some of which can be compressed and some of which can flow from one area to another to vary the weight characteristics of the golf club components. The patent to Simmons U.S. Pat. No. 3,817,522 discloses a golf club head having a gas filled chamber provided with a wall fabricated from a relatively thin plastic material so that the gas filled chamber can magnify the forces imparted to the ball when hit with the club head. Other of the patents disclose pressurizing the components of a golf club to enhance operation of the club.

None of the above patents disclose, however, a club head in the shape of a driver constructed of a rigid hollow casing provided with an inflatable bladder for reinforcement of the casing walls which enables the casing to be constructed of a lighter weight and thinner material with the striking face of the casing being inclined in a conventional manner. The prior art also does not disclose an inflatable bladder which enables a metal or composite golf club head to provide a sound and "feel" closely simulating to the sound and "feel" produced when a real wood driver impacts a golf ball. The "feel" (not in quotes hereafter) can generally be described as smooth contact when hitting the golf ball, not sharp or harsh contact.

Further, the above listed patents do not disclose the reinforcement and rigidification of a hollow golf club shaft by utilizing an inflatable bladder extending substantially throughout the length of the shaft. Additionally, the above listed patents do not disclose a golf club shaft having internal and/or external grooves and ribs for reducing the weight and/or reinforcement of the club shaft.

SUMMARY OF THE INVENTION

The golf club of this invention includes features which rigidify and reinforce the major components of the golf club including the golf club head and the golf club shaft of conventional designs and constructions. Such reinforcement enables the golf club components to be constructed of lighter weight metal or other composite materials of known types, thus providing better control of the golf club during a golf club swing. Additionally, the insertion of an inflated and pressurized bladder into an otherwise hollow club head provides a different sound and a different feel at ball impact that should appeal to many golfers. And, the insertion of an inflated and pressurized bladder into an otherwise hollow club shaft provides improved vibration dampening and feel at ball impact.

It is an object of one embodiment of this invention to provide a golf club head in the conventional shape and configuration of a driver, or other wood club, having a relatively thin hollow metal casing and a ball striking face thereon inclined at a desired inclination, with the hollow interior of the club head provided with an inflatable flexible bladder which can be inflated with an appropriate gas at a predetermined pressure with the bladder being sealed within the casing to enhance the function of the club head when driving a golf ball.

An object of another embodiment of the present invention is to provide a hollow metal golf club shaft of conventional shape and configuration with an inflatable flexible bladder which can be inflated to a predetermined pressure by an appropriate gas and sealed to rigidify, reinforce and enhance the performance of the club shaft and at the same time enabling the club shaft to be constructed of thinner and thus lighter weight metal or other material of various types.

An object of a further embodiment of the invention is to provide a hollow metal golf club shaft with grooves formed therein to reduce the weight of the shaft and increase the rigidity thereof, with the grooves being internal, external, or both internal and external, and being spiral, or circumferential to the shaft axis.

Another object of the present invention is to provide a golf club utilizing a single or multiple arrangement of the previously mentioned embodiments in which the inflatable bladder in the club head can be used alone or in combination with the inflatable bladder in the club shaft or with the grooved club shaft. The inflatable bladder in the club shaft can be used with or without the grooves in the club shaft and the grooves in the club shaft can be used with or without either of the bladders. Additionally, the various types of grooves may be used singly or in combination with each other and singly or in combination with either or both of the inflatable bladders. For example, the inflatable bladder in the club shaft and/or grooving of the club shaft are equally applicable to the so-called "iron" golf clubs as to the driver and other wood clubs.

A further object of the present invention is to provide a golf club in accordance with the preceding objects which produces an improved sound when the golf club head strikes a golf ball, an improved feel to the golf club when the golf club head strikes a golf ball, better control of the path of movement of the golf club when it is swung, a different weight distribution in the golf club head that can lead to a wider sweet spot and more consistency on off center shots, reduction in the thickness of the walls of the club shaft and club head, improved weight distribution in the head for a more effective striking and control for off center hits, and variation in the head weight of the golf club by selecting bladders of different weights to provide for custom club lengths and weights.

A still further object of the present invention is to provide a golf club in accordance with the preceding objects which can be tuned to the player by adjusting the gas pressure within certain limits in the inflated bladder or bladders and provide a signature sound and/or feel to be produced upon ball impact to distinguish the golf clubs incorporating the present invention from other existing clubs.

The present invention also improves the playability of golf clubs by people having arthritis, tendonitis and other hand and arm infirmaties by providing a golf club with reduced vibration and shock characteristics.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
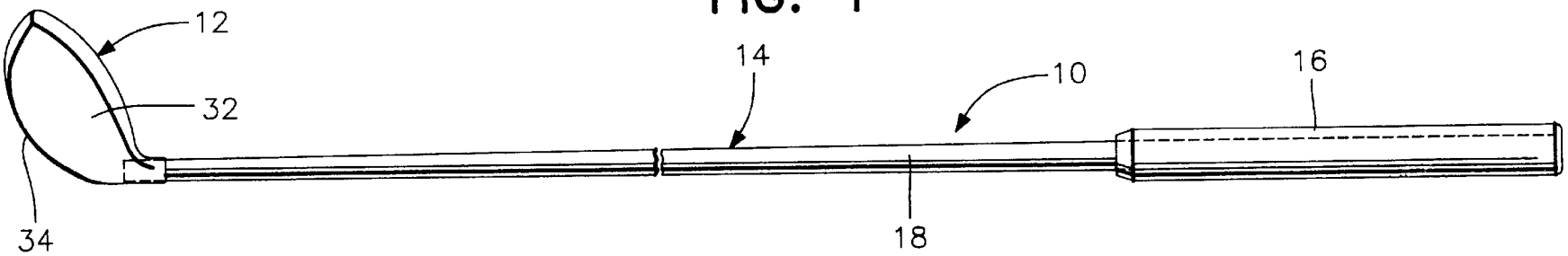
FIG. 1 is a side elevational view of a golf club in the form of a driver incorporating features of the present invention therein.

In describing the preferred embodiments of the present invention as illustrated in the drawings, specific terminology will be resorted to for the sake of clarity. However, the invention is not intended to be limited to the specific embodiments illustrated and terms so selected; it being understood that each specific term includes all technical equivalents which operate in a similar manner to accomplish a similar purpose.

Referring to FIG. 1, a golf club embodying the present invention is designated generally by reference numeral 10. The club 10 includes a hollow club head in the shape of a driver or other wood club, generally designated by the numeral 12, and a tapered hollow shaft, generally designated by the numeral 14. Preferably, the club head and shaft are made of metal of the various types used for making golf club heads and shafts, but can be made of any suitable composite or other material. The metal shaft 14 is connected to the metal club head 12 in any known manner. The shaft 14 also includes a hand grip 16 of any known construction at the end remote from the club head.

Figure 2:
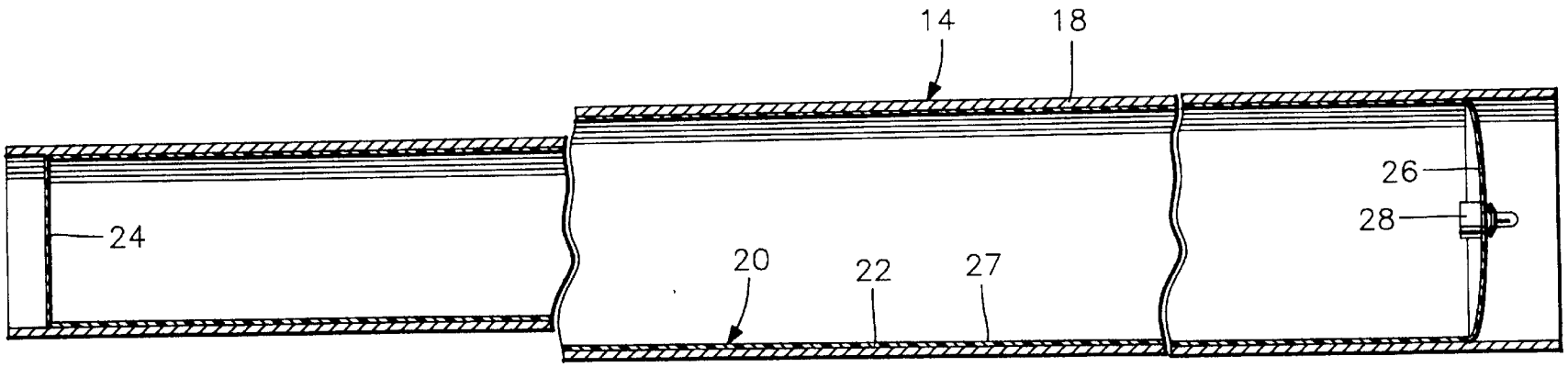
FIG. 2 is an enlarged longitudinal sectional view of the tapered golf club shaft illustrating an inflated bladder incorporated in the shaft in accordance with the present invention.
Figure 3:
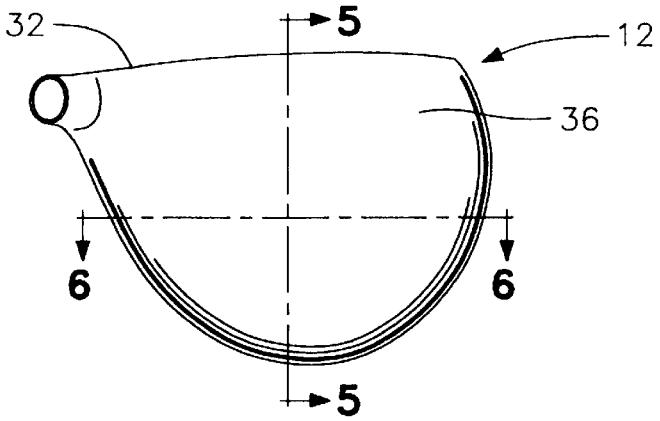
FIG. 3 is a top view of a golf club head having an inflatable bladder in accordance with the present invention.

FIG. 2 illustrates an embodiment of the club shaft 14 in accordance with the present invention. The shaft 14 can be made of any known design or construction. As illustrated, the shaft 14 is a conventional shaft having a continuous tube or tubular wall 18 that extends from the club head 12 to the distal end of the hand grip 16. The length of the club shaft is conventional and may vary depending upon the person using the golf club. As conventional in the art, the tube 18 preferably has a tapered central section. For example, the shaft 14 has a total length of approximately 40 to 48 inches with approximately the outermost few inches being of constant diameter of up to approximately 0.865 inches and the remainder then tapering gradually to a constant diameter portion of down to approximately 0.335 inches for approximately the remaining 5 to 6 inches. This length and tapered configuration may vary depending upon the materials used and depending upon the wall thickness of the shaft.

FIG. 2 also illustrates an inflated bladder, generally designated by reference numeral 20, which can extend up to the full length of the club shaft 14, as illustrated. However, the bladder 20 can preferably be confined to the larger diameter portion of the shaft comprising the upper third, or approximately the upper 15 inches. In this regard, it is possible to adjust the stiffness distribution in the shaft 14 by selecting the location of the bladder 20 and adjusting the pressure to which the bladder is inflated and pressurized.

The bladder 20 preferably includes a generally cylindrical peripheral wall 22, an end 24 connected at one end of the cylindrical peripheral wall 22 and an end 26 at the opposite end of the peripheral wall 22. In view of the tapered central section of the shaft 14, the bladder 20 preferably tapers likewise with the end 24 nearest the club head 12 being substantially less in diameter as compared to the end 26 at the hand grip end of the wall. The end 26 includes a valve 28 which can be used to inflate the bladder 20. The inflation valve 28 may be of the type in which a inflation needle can be inserted to enable the bladder 20 to be inflated through the hand grip end of the shaft 14 or any other valve construction which permits the bladder to be inflated after being positioned in the shaft. While not preferred, the bladder could be preinflated and inserted into the hand grip end of the shaft 14 after a predetermined pressure has been obtained in the bladder 20 with the hand grip 16 then being mounted on the shaft in a conventional manner. The bladder 20 is preferably constructed of a flexible material such as plastic, rubber or the like and is inflated with a compressible gas. Large molecule gases like argon may make pressure maintenance more permanent.

In the preferred embodiment with the uninflated bladder 20 inserted within the hollow shaft 14, the bladder is inflated and pressurized through the valve 28 in the end 26. The pressurization of the bladder 20 causes the peripheral wall 22 to expand into engagement with the interior surface 27 of the shaft 14, thus placing an outward force on the shaft wall. This outward force supports the shaft wall and outwardly pressurizes the wall to thereby enable the wall to be constructed with less thickness and with less weight. The outward force exerted on the shaft wall also reinforces and stiffens the wall and resists deformation. Further, the pressurization of the bladder 20 and the resultant reinforcement and stiffening of the shaft wall serve to dampen the vibration transmitted up the shaft when the club head strikes a golf ball and improves the feel of the club at the same time.

Figure 4:
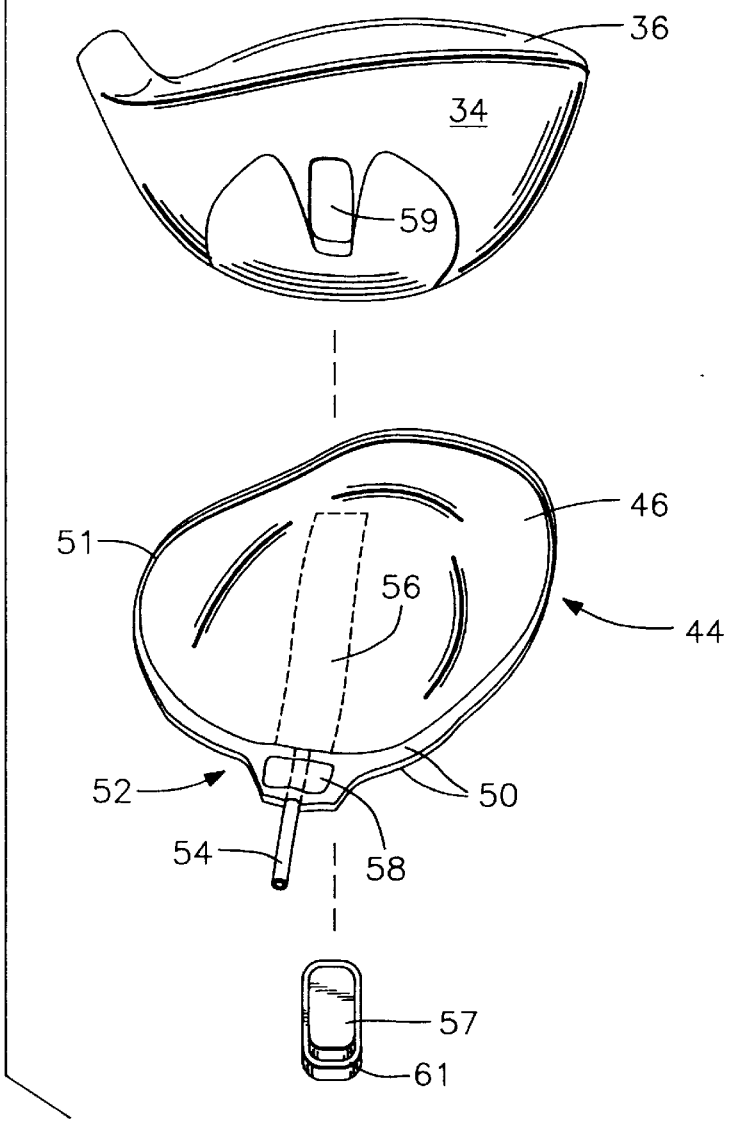
FIG. 4 is an exploded perspective view of the bottom side of an empty club head having an elongated opening therein, a generally flat uninflated bladder in accordance with the present invention and a closure for the opening.

FIGS. 3–6 illustrate an embodiment of the club head 12 in accordance with the present invention. The hollow golf club head 12 includes a casing 30 in the configuration of a driver or other wood club. The club head 12 and its metal casing 30 can be made of any known design or construction and, as illustrated, includes an inclined ball engaging or striking face 32, a rounded bottom wall or sole 34 and a top wall 36. The top wall 36 and the sole 34 are conventionally (but not always) convexly curved on the outer surface and are joined along a rear edge 38 opposite to the ball striking face 32. Also, the top wall 36 is slightly curved from the toe 40 to the heel 42 and the bottom wall or sole 34 is generally semicircular from the toe 40 to the heel 42 as shown in FIG. 4. The curvature and configuration of the striking face 32, the top wall 36, the sole 34 and the heel and toe of the club head are all of conventional design and configuration and can simulate a wood club. The hollow casing 30 is constructed of metal, composite or other suitable material, and the ball striking face 32 is preferably provided with surface grooves or indentations to enable proper impact with a golf ball in a manner well known in the construction of drivers and other wood clubs.

Positioned within the interior of the hollow casing 30 is an inflatable bladder, generally designated by the numeral 44. As illustrated in FIG. 4, the bladder 44 when uninflated includes a pair of substantially identical, flat panels 46 made from thin sheet or film material. Each panel 46 is generally circular and has mating side edges 50 which are seamed together around the periphery of the panels by heat sealing or frequency welding or other conventional sealing connection, as at 51. When inflated within the hollow casing 30, the panels 46 expand into engagement with the full interior of the hollow casing 30. Thus, the inflated bladder 44 conforms with and preferably engages the entire inner surface of the casing 30.

A pressure sealing valve assembly, generally designed by the numeral 52, extends from outside the bladder 44 to inside the bladder between the layers 46. The valve assembly 52 includes a central tube 54 which extends through the seam 51 and a flat flexible tube 56 surrounding and joined to the inner end of the tube 54 in a manner to receive pressurized gas therethrough. The walls of the flat tube 56 are substantially more flexible than the tube 54 so that gas pressure within the interior of the inflated bladder 44 will maintain the flat tube 56 in a closed and sealed condition when there is no higher pressure forcing gas into the bladder 44 through the tube 54. The tubes 54 and 56 are preferably made of any suitable known plastic material.

As illustrated, the flat panels 46 include a flattened axial projection 58 that effectively seals around the inflation tube 54. Thus, the tube 54 constructed of a plastic material can be heated and deformed or otherwise sealed to form a second seal in addition to the seal formed by the highly flexible flat tube 56, thereby securing the gas pressure within the bladder 44. If desired, each panel 46 could include more than one layer of thin sheet or film material, such as a double panel, or an outer panel of different material as described in connection with the embodiment of FIGS. 7–9, or a panel made by laminating or bonding two different materials together. Further, each periphery 50 could have a separate reinforcing layer to reinforce the sealing connection 51 around the periphery of the bladder, or the flattened axial projection 50 could have reinforcing panels on each side of flat panels 46 to reinforce the seal around inflation tube 54, as described in connection with the embodiment of FIGS. 10 and 11.

Figure 5:
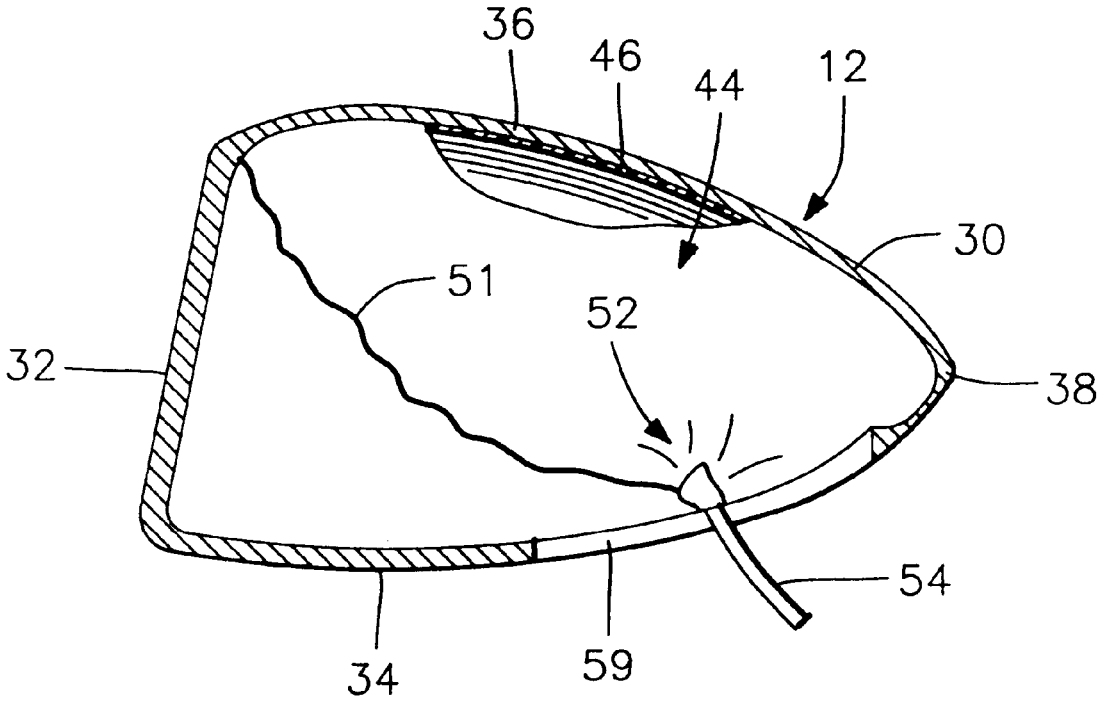
FIG. 5 is a sectional view of the golf club head and partial sectional view of the inflated bladder taken in a vertical plane generally perpendicular to the golf ball striking face along line 5—5 of FIG. 3.
Figure 6:
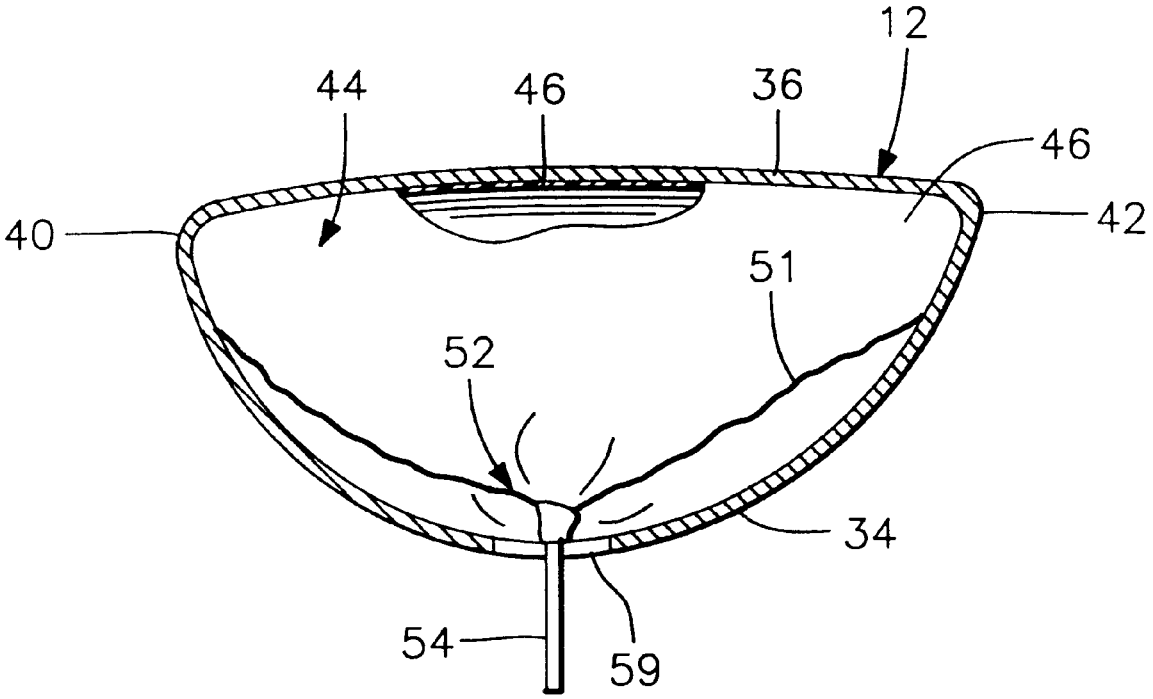
FIG. 6 is a sectional view of the golf club head and partial sectional view of the inflated bladder taken along a vertical plane generally along line 6—6 of FIG. 3.

As illustrated in FIGS. 4–6, the sole 34 of the golf club head 12 has a slot 59 or hole in the rearward portion thereof which provides access to the interior of the casing 30. A typical size for slot or hole might be ¼ inch by ¾ inch. When uninflated, the flat bladder 44 can easily be folded over and inserted into the interior of the casing 30 through the access slot or hole 59. After insertion; the bladder 44 unfolds in the interior of the casing 30 with the flexible tube 54 extending out of the access slot. The bladder 44 can then be inflated and pressurized through the flexible tube 54 as it extends out through the slot-like opening 59. Once the bladder 44 is inflated to the desired pressurization, the flexible tube 54 can be heated to form a second seal, and a closure 57 in the form of a cap or plug, can be inserted to close the opening 59. A lip 61 around plug 57 can mate with a corresponding recess around opening 59 (not shown) so that the outer surface of closure 57 conforms to the surface of sole 34. If desired, the closure 57 can be glued or welded in place in the opening 59.

The inflation and pressurization of the bladder 44 within the confines of the interior of the casing 30 exerts an outward pressure on all of the interior surfaces of the casing 30. This outward pressure or force pressurizes all of the walls of the casing 30, including the ball striking face 32, thereby reinforcing and stiffening all of the peripheral walls of the casing 30. This reinforcement and stiffening of the club head walls by the pressurized bladder in accordance with the present invention permits the wall thickness of the club head casing to be reduced on the order of about 0.005 to about 0.030 inches. Further, the material of the club head can be redistributed for more perimeter weighting and more stability on off center hits.

Figure 7:
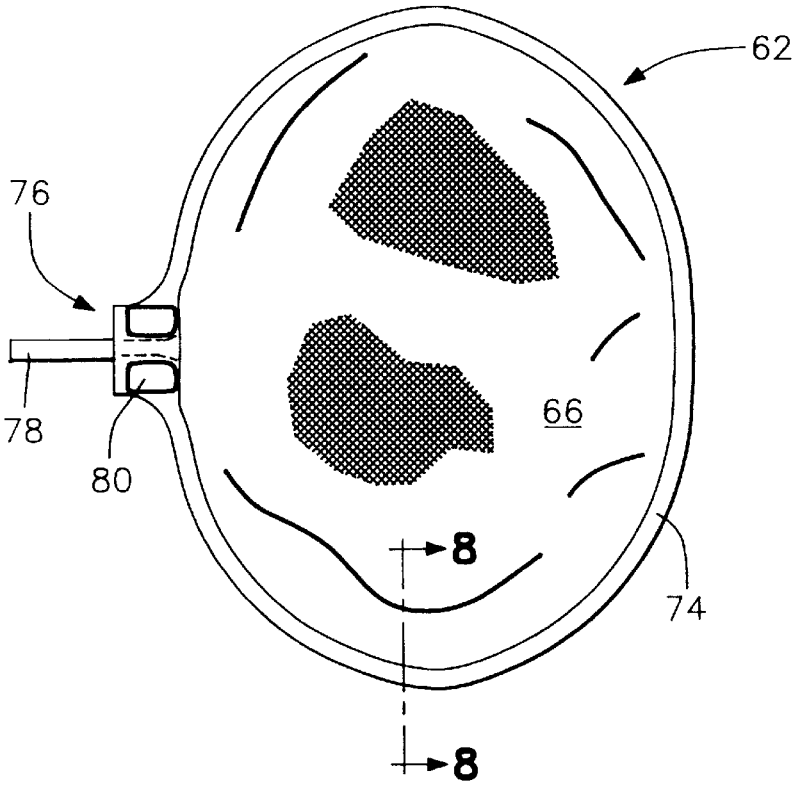
FIG. 7 is a top view of another uninflated bladder for the golf club head in accordance with the present invention.
Figure 8:
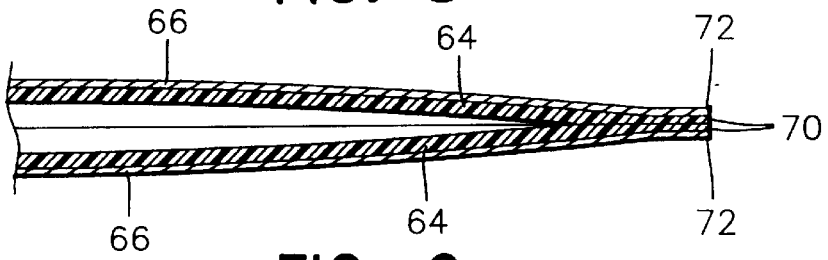
FIG. 8 is a partial sectional view of the uninflated bladder illustrated in FIG. 7, taken along line 8—8.
Figure 9:
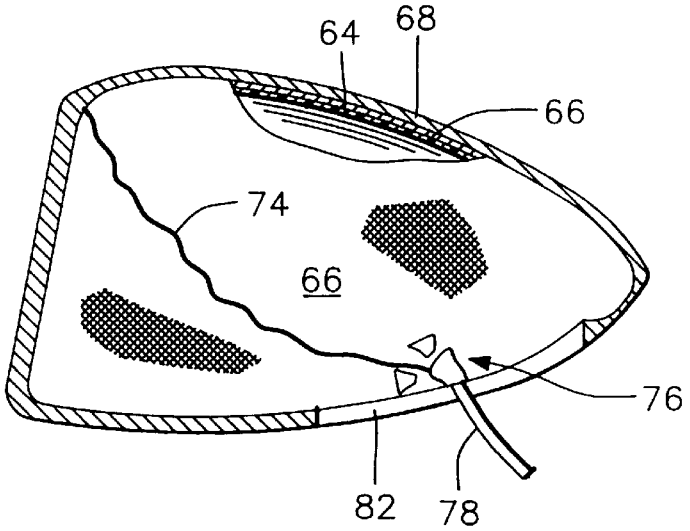
FIG. 9 is a sectional view of a golf club head and partial sectional view of the inflated bladder of FIG. 7 taken in a vertical plane similar to FIG. 5.

Turning now to FIGS. 7–9, there is shown another embodiment of an uninflated bladder, generally designated by the numeral 62, for insertion and inflation in the golf club head according to the present invention. The bladder 62 is similar to the bladder 44 in that when uninflated, bladder 62 includes a pair of substantially identical, flat inner panels 64 made from thin plastic sheet or plastic film material. However, bladder 62 differs from bladder 44 in that bladder 62 includes outer layers or panels 66. The panels 66 preferably have substantially the same size and shape as panels 64 to thereby cover the entire outer surface of the panels 64. The inner panels 64 and outer panels 66 each have mating side edges 70 and 72, respectively, which are seamed together around the periphery of the panels by heat sealing or frequency welding or other conventional sealing connection, as at 74. The outer panels 66 are preferably made of fabric or other material having a slippery outer surface.

When inflated within the hollow casing 68, the panels 64 and 66 expand, and panels 66 engage with the interior of the hollow casing 68. Thus, the outer panels 66 serve to protect the inner panels 64 which hold the air or gas pressurization within the bladder 62. This protection can be important in some club heads to prevent abrasions or cuts in the panels 64 by burrs or other sharp objects inside the hollow club head 68. The inflated bladder 62 preferably conforms with and engages the entire inner surface of the casing 68 in order to provide reinforcement and rigidity for all of the club head surface, including the ball striking face.

The bladder 62 includes a pressure sealing valve assembly, generally designated by the numeral 76, which extends from outside the bladder 62 to inside the bladder between the layers 64. As previously described in connection with the bladder 44, the valve assembly 76 includes a central tube 78, which extends through the seam 74 and a flat flexible tube (not shown in this embodiment) surrounding and joined to the inner end of the tube 78, as previously described for bladder 44. As shown, the flat panels 64 and 66 include a flattened axial projection 80 that effectively seals around the inflation tube 78.

When uninflated, the flat bladder 62 can easily be folded over and inserted into the interior of the casing 68 through the access slot or hole 82. After insertion, the bladder 62 is inflated through the flexible tube 78 as it extends out through the slot opening 82. The outer panels 66 protect the inner panels 64 during the inflation and pressurization procedure, especially against abrasion and cutting by burrs or sharp edges on the interior of the hollow casing 68. Further, the preferred slippery outer surface for outer layers 66 assists in expanding the bladder 62 during inflation and pressurization over the burrs, sharp edges or other irregularities inside the casing 68 to avoid cutting or abrasion of the bladder and to expand the bladder into all of the interior space of the casing 68.

As presently contemplated, the outer panels 66 are slippery on the outside and preferably tacky on the inside. It is believed that any slippery fabric can be used for the outer panels 66, and the inside can be coated to make tacky, as desired. Nylon fabric coated on the inside with a polyurethene coating has been found suitable for layers 66. While such layers 66 separate and apart from the inner plastic layers 64 have been found satisfactory, it is contemplated that the outer fabric layer, such as nylon, can be bonded or laminated directly to the thin plastic sheet or plastic film material forming inner panels 64 to form an integral sheet material from which the bladder panels can be cut prior to edge sealing or seaming together.

Figure 10:
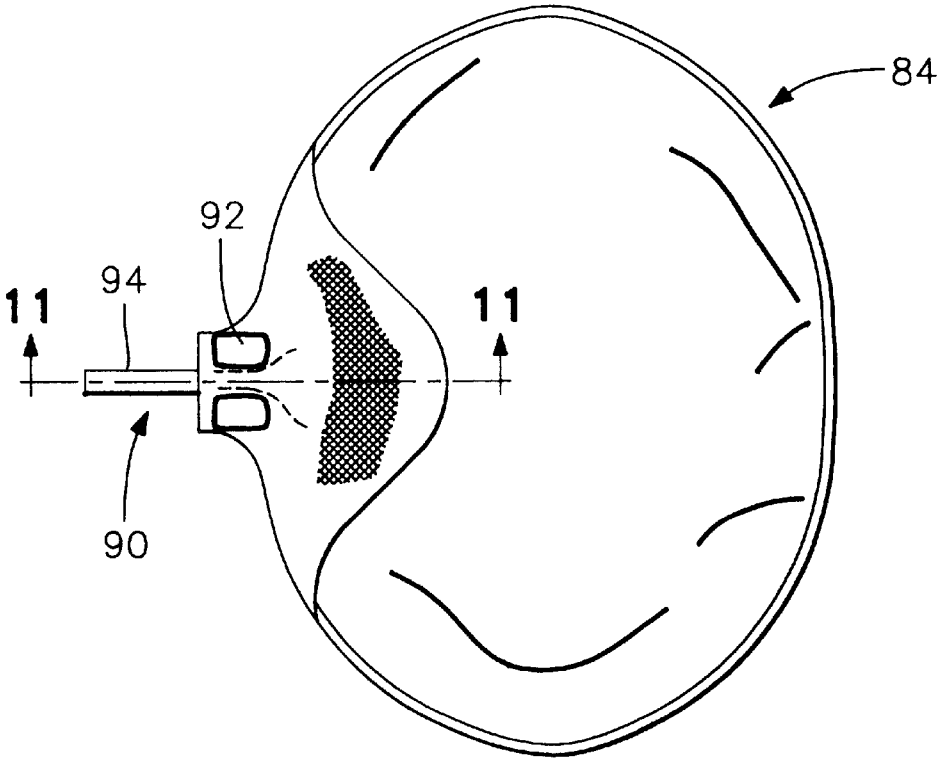
FIG. 10 is a top view of yet another uninflated bladder for the golf club head in accordance with the present invention.
Figure 11:
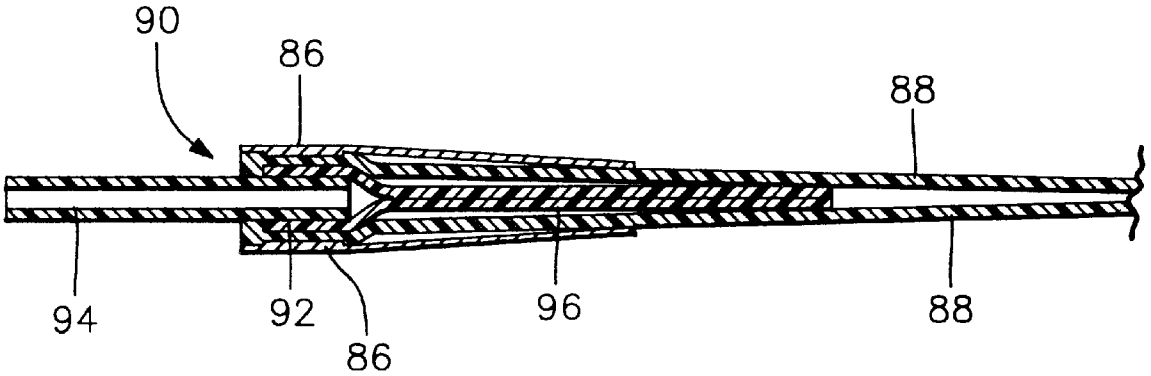
FIG. 11 is a partial sectional view of the uninflated bladder of FIG. 10 taken along line 11—11 and illustrating the preferred inflation tube and valve.

Referring now to FIGS. 10 and 11, there is disclosed a third embodiment of an inflatable bladder, generally designated by the numeral 84, for positioning and inflation within the interior of the hollow casing of a golf club head. Bladder 84 is similar in design, construction and operation to the previously described bladders 44 and 62, except that bladder 84 includes outer layers 86 over bladder panels 88 only in the area of the pressure sealing valve assembly, generally designated by the numeral 90. In this embodiment, the layers 86 serve primarily to reinforce the flattened axial projection 92 that effectively seals the bladder layers 88 around the inflation tube 94.

As illustrated in FIG. 11, the central tube 94 of the pressure sealing valve assembly 90 extends from outside the bladder 84 to inside the bladder between layers 86 and 88. A flat flexible tube 96 surrounds and joins the inner end of the tube 94 in the manner previously described to receive pressurized air or gas into the interior of the bladder 84. As previously described, the walls of the flat tube 96 are substantially more flexible than the tube 94 so that the pressure within the interior of the inflated bladder 84 will maintain the flat tube 96 in a closed and sealed condition when there is no higher pressure forcing air or other gas into the bladder 84 through the tube 94. The tubes 94 and 96 are preferably made of any suitable known plastic material, and the tube 94 can be readily deformed by heat to form a second seal for the bladder 84 when inflated and pressurized to the desired level.

Figure 12:
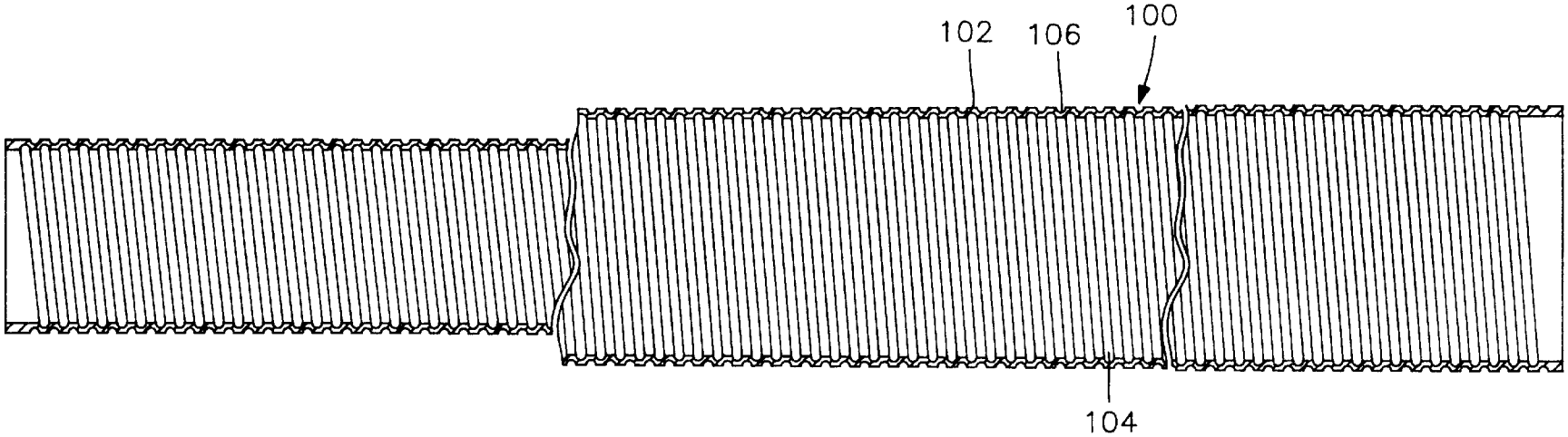
FIG. 12 is an enlarged sectional view of the tapered golf club shaft having spiral ribs and grooves formed in both the external and internal surfaces.

FIG. 12 illustrates a golf club shaft 100 of hollow, tapered construction made of metal, composite or other suitable material, which is the same as that illustrated in FIG. 2 except that the interior of the peripheral wall 102 is provided with a spiral groove 104 and the exterior is provided with a similar spiral groove 106 thus forming a spiral rib and groove arrangement on both the internal and external surfaces of the shaft 100. Alternatively, the peripheral wall 102 may be provided with only interior groove 104 or only external groove 106.

Figure 13:
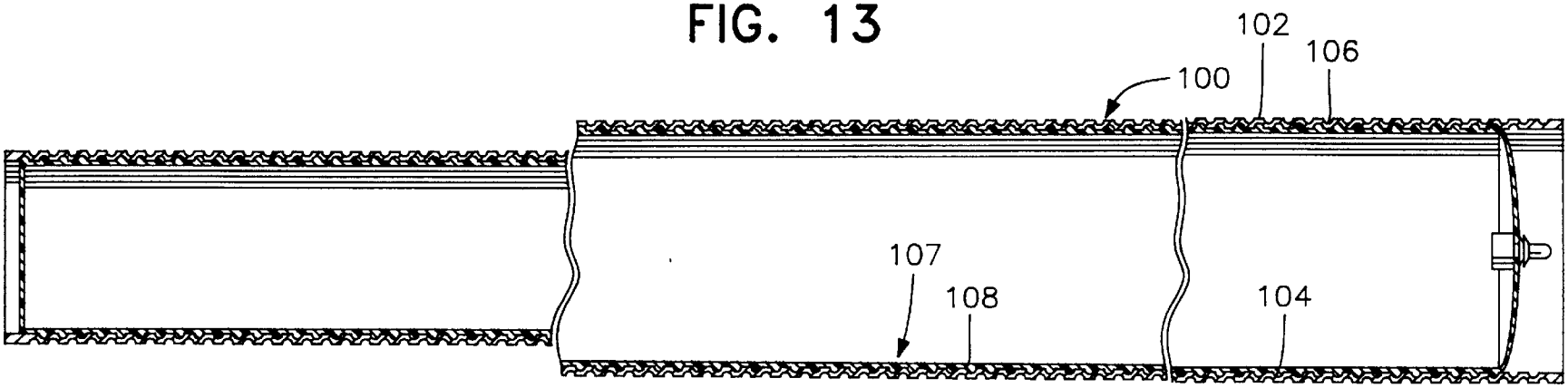
FIG. 13 is a sectional view similar to FIG. 12 in which an inflated bladder is positioned within the interior of the grooved hollow tapered shaft of FIG. 12.
Figure 14:
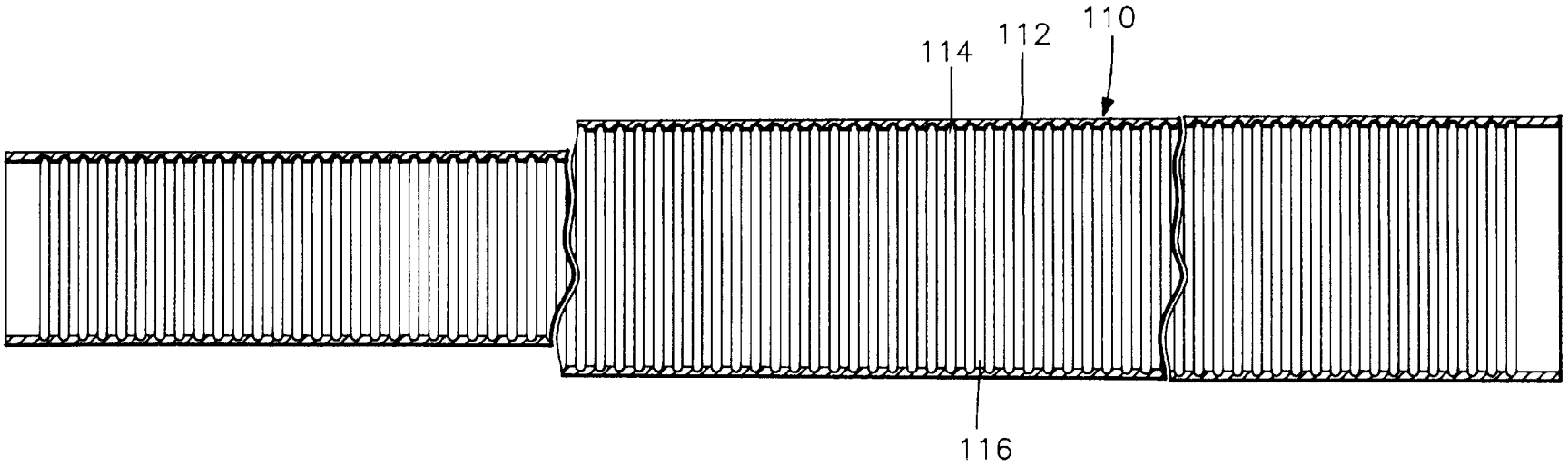
FIG. 14 is an enlarged sectional view of the tapered golf club shaft having circumferential, perpendicular to axis grooves on the inner surface.

FIG. 13 illustrates the shaft 100 of FIG. 12 provided with a bladder 107 which, as illustrated, has the same construction as the bladder 20 in FIG. 2. However, the bladder 107 could have a construction of the type described for bladders 44, 62 or 84, but configured to fit the appropriate portion of shaft 100 to be reinforced and stiffened. The flexibility of the peripheral wall 108 of the bladder 107 enables the bladder generally to follow the contour of the spiral grooves on the interior surface of the wall 102 of the shaft 100. The bladder 107 reinforces and rigidities the peripheral wall 102, thus permitting the shaft to be made of thinner metal to reduce the weight of the shaft. Rather than thinning the wall thickness, the shaft material can be removed from the peripheral wall 102 by providing the internal spiral groove 104 or external spiral groove 106 to thus remove the requisite material. The thinning or grooving of the wall thickness is preferably throughout the length of the shaft, but can be confined to a certain area, such as the tapered section or one or both of the cylindrical sections of the club shaft or in the area of the shaft where the peripheral wall of the bladder engages the shaft wall. Where internal spiral groove 104 is provided on the peripheral wall 102, it may be desirable to encase the cylindrical wall of bladder 107 with a high strength film, or fabric as in bladder 62, so as to prevent the interior grooving from damaging the bladder during bladder inflation and club use. FIG. 14 illustrates a golf club shaft 110 of hollow metal construction in which the interior surface of the peripheral wall 112 is provided with a plurality of circumferential, parallel grooves 114 which define corresponding parallel ribs or ridges 116 to reinforce and rigidify the wall 112 of the shaft 110.

The pressurized bladders for the golf club head and golf club shafts in accordance with the present invention are particularly adaptable to club heads and shafts constructed of metal, such as titanium, aluminum, steel or other high strength metals or alloys. However, the present invention is not limited to metal heads or shafts. Rather, the present invention is applicable to these golf club components constructed of other known materials including composite thermoset and thermoplastic materials or other structural materials such as combined metal/composite, metal ceramic or other yet to be defined materials. A reinforcing bladder in either the golf club head or golf club shaft or both, in accordance with the present invention, serve to dampen vibrations that would normally be transmitted to the hands gripping the hand grip when the club head impacts a golf ball. Further, a reinforcing bladder or bladders improve the club sound and feel upon impact with the golf ball so as to more closely approximate the sound and feel occurring when a wooden club strikes a golf ball. In this regard, it is believed that vibration reduction, sound difference, and feel difference result from the viscoelastic nature of the bladder contacting the surface of the club head and or club shaft, and changing and dampening the resonant frequency of the head and shaft.

The grooved construction formed in the shaft, either on the interior surface or the exterior surface or both, provides a lighter weight shaft while maintaining the desired level of structural integrity and strength. The lighter weight club shaft made possible by the various embodiments of the present invention also enables the club head speed to be increased thereby increasing the exit velocity of the golf ball as it leaves the impact area due to the greater club head speed. This structure also enables the club head to have greater relative weight while retaining the same total weight of the club by using the lighter weight construction of the club shaft. This structure also enables the club head to include a larger acceptable impact area on the ball engaging face. The symmetrical configuration of the club shaft is retained and the modulus of elasticity is also maintained in the club shaft.

The inflatable bladder constructions of the present invention can be incorporated into various hollow club heads, such as those which are shaped in a configuration similar to a driver. More specifically, the inflatable bladder of this invention could be used in all club heads of the "woods" group. Further, golf club shafts with inflatable bladders in accordance with the present invention, as well as grooved shafts, could be incorporated into any golf club, including the "woods" and the "irons" groups.

While the slotted hole 59 in the sole 34 of the club head facilitates easy insertion of the bladder, any shaped hole and plug could be used if desired, such as a cylindrical threaded hole and plug. Also, the opening and plug could be provided at any convenient location in the club head, except the ball striking face, including the crown, the sole area or around the skirt area of the club head.

The pressurization level of the bladders 20 and 67 for the club shaft and bladders 44, 62 and 84 for the club head can range in accordance with the present invention from as little as about 5 pounds per square inch above atmospheric pressure ("psi") to as high as about 50 psi, or even higher for special constructions. Normally, the pressurization for the club shaft should range between about 15 psi to about 50 psi and, preferably, between about 20 psi and about 30 psi. The pressurization for bladders 44, 62 and 84 in the club head should normally range between about 10 psi to about 40 psi and, preferably, between about 15 psi to about 35 psi. Any appropriate gas can be used to pressurize the bladders in accordance with the present invention, although gases such as air, nitrogen, and argon, or large molecule gases can be used. Presently, air and argon are the preferred pressurizing gases.

Each of the bladders 20, 44, 67 and 84 may be constructed of any suitable thin sheet or film material including resilient flexible materials or semirigid material, made from neoprene, polyvinylcloride (vinyl), polyurethene esters, polyurethene ethers, olefins, polyesters, polyethylterephthlate, elastomers, polyethylene, polypropylene and other suitable plastics and the like, or even substantially rigid materials such as rigid plastic, metal or composite materials. Of these three different types of materials for constructions of the bladder or bladders, resilient flexible materials are most preferred and substantially rigid materials are least preferred. Each bladder may be made of a single cell or compartment or multiple cell or compartments.

The thickness of the thin sheet, film and/or materials from which the bladders are constructed in accordance with this invention can vary from material to material, depending upon the strength, toughness and life characteristics of the particular material. Typically, appropriate materials having a total thickness in the range of 15 mils can be used. In view of the desirability of reducing the weight of the club, economical materials having high weight to strength ratios are preferred, consistent with the necessary toughness and long life required for use in a golf club head and/or shaft. It is believed that all of the bladder constructions disclosed in the instant application can be formed by the materials described herein. The construction of bladder 67 is presently preferred for the club head, especially one where a slippery fabric can be molded directly to the inner plastic layer before the panels are cut and the bladder formed.

Where the bladder is made from a resilient flexible material, the size of the inflated bladder, such as bladders 44, 62 and 84 for a golf club head, should be slightly larger than the internal dimensions of the respective hollow head casing so as to ensure engagement between the bladder and the entire internal surface of the casing after inflation. This arrangement allows for variations in the internal dimensions of the club head casing.

In circumstances where a semirigid material is used for the bladder, such as bladder 20 or bladder 67 for the club shaft, it may be desirable to size the diameter of the generally cylindrical peripheral wall slightly less than the internal diameter of the shaft wall so as to permit easy insertion of the bladder into the shaft and have the peripheral wall expand into surface-to-surface contact with the interior surface of the shaft wall upon inflation or pressurization of the bladder. Where a rigid material is used for the bladder structure in a club shaft, the cylindrical peripheral wall of the bladder should be tapered to have an outside diameter designed to be the same as the internal diameter of the shaft wall so that as close to a surface-to-surface contact with the interior surface of the wall can be achieved. The peripheral wall of the bladder then serves as a reinforcement for the shaft wall.

It may also be possible in accordance with the present invention for the bladder component to be constructed in various forms and shapes. While a tapered generally tubular bladder is preferred for the club shaft, it will be obvious to those skilled in the art that any elongated, or other, shape could be constructed, especially using the flat sheet technology disclosed in connection with the bladders 44, 62 and 84. Further, any number of bladders could be designed to apply the requisite internal pressure to the club head or club shaft. As mentioned earlier, any bladder could also be divided into two, three or more separate cells or chambers. In such case, each cell or chamber should be provided with a separate valve either through the external wall of the bladder or, preferably, through an internal wall dividing the chambers or cells each from the other. For example, a single internal wall could divide a bladder into two chambers, or two internal walls could divide a bladder, such as an elongated bladder, into three chambers in series. A valve, such as complete valve assembly 52, could feed the pressurizing gas into one of the chambers and another valve, such as flat flexible tube 56 installed in each internal wall, could feed the pressurizing gas from the one inflated chamber into the one or two other chambers, either at the same time, or serially if the bladder has three chambers.

The pressurized bladder or bladders in accordance with the present invention are confined within the interior surface of the club head and/or club shaft of the golf club thereby exerting outward pressure on these interior surfaces. This outward pressure or force pressurizes the peripheral wall of the club head casing and/or club shaft wall as the case may be, thereby reinforcing and stiffening the peripheral walls. As previously described, the bladder reinforcement and stiffening of the club head and/or club shaft enables the peripheral wall of the club component to be constructed of a thinner material thereby reducing the overall weight of the golf club so that the club speed can be increased by exerting normal swinging force on the golf club. This also enables the ball strike plate of the club head to contact a golf ball with a greater velocity thereby increasing the exit velocity of the ball. Further, pressurization of the club head casing and ball striking plate allows the material of the club head to be redistributed for more perimeter weighing and more stability on off center hits. It is believed that this increased stability results in less fall off in performance on off center shots. Additionally, utilization of a bladder in the head and/or shaft of a metal golf club significantly reduces the level of vibration transmitted to the club handle and improves the club sound and feel upon impact with the ball.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed is:

1. A golf club comprising a shaft connected to a golf club head formed of a casing having a hollow interior and a golf ball striking face, and an inflated and pressurized bladder positioned within said casing behind said face and in supporting relation to the interior of the casing, said bladder reinforcing and rigidifying the casing and the striking face, wherein said hollow casing has an opening for insertion of said flexible inflatable bladder prior to inflation.

2. The golf club as defined in claim 1 wherein said hollow casing is metal.

3. The golf club as defined in claim 1 wherein said shaft is a hollow metal shaft including a hand grip on an end thereof remote from the club head and tapering from a larger diameter at the hand grip end to a smaller diameter where it is connected to the club head, said hollow shaft including an inflated bladder having a peripheral wall engaging and supporting a peripheral wall of said shaft.

4. The golf club as defined in claim 1 wherein said shaft is a tapered hollow metal shaft which includes a plurality of grooves formed therein to reinforce and rigidify the shaft to enable the shaft to be made with thinner lightweight material.

5. The golf club as defined in claim 4 wherein said golf club shaft includes an inflated bladder extending over all or a portion of the shaft length.

6. The golf club as defined in claim 1 wherein said flexible inflatable bladder includes an inflation tube and seal for inflating said bladder after insertion into said head.

7. The golf club as defined in claim 6, where said opening receives a closure therein after said bladder is inflated.

8. The golf club as defined in claim 6 where said bladder comprises a pair of substantially identical flat panels each having mating side edges, said mating side edges of said flat panels being sealed together to form said bladder.

9. The golf club as defined in claim 8, where said bladder has an external surface and where said inflation tube includes an outer protective layer on at least a portion of said bladder external surface.

10. The golf club as defined in claim 1 wherein said bladder is inflated to a pressure between about 10 psi to about 40 psi.

11. The golf club as defined in claim 1, where said hollow casing includes a sole portion, said opening being in said sole portion.

12. The golf club as defined in claim 1, where said bladder comprises at least a pair of flat panels each having mating side edges, said flat panels having a pressure sealing valve assembly inserted therebetween and extending outward therefrom, said mating side edges of said flat panels being sealed together to form said bladder.

13. The golf club as defined in claim 12, where said bladder has an external surface and where said pressure sealing valve assembly includes an outer protective layer on at least a portion of said bladder external surface.

14. The golf club as defined in claim 1 where said hollow casing was a wall thickness, said wall thickness being between 0.005 inch and 0.030 inch.

* * * * *